US008960853B2

(12) United States Patent
Kobayashi

(10) Patent No.: US 8,960,853 B2
(45) Date of Patent: Feb. 24, 2015

(54) IMAGE FORMING APPARATUS AND EXPOSURE DEVICE

(71) Applicant: Fujixerox Co., Ltd., Minato-ku, Tokyo (JP)

(72) Inventor: Takahiko Kobayashi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/959,993

(22) Filed: Aug. 6, 2013

(65) Prior Publication Data

US 2014/0232803 A1 Aug. 21, 2014

(30) Foreign Application Priority Data

Feb. 19, 2013 (JP) ..... 2013-029672

(51) Int. Cl.
*B41J 2/01* (2006.01)
*G03G 15/04* (2006.01)

(52) U.S. Cl.
CPC ..... *G03G 15/04036* (2013.01)
USPC ..... 347/20

(58) Field of Classification Search
CPC ..... B41J 2/1623; B41J 2/1631; B41J 2/1628; B41J 2/14024; B41J 2/1603
USPC ..... 347/20
See application file for complete search history.

(56) References Cited

U.S. PATENT DOCUMENTS

2004/0228652 A1* 11/2004 Fujiwara ..... 399/117
2009/0274488 A1* 11/2009 Sugiyama ..... 399/217
2011/0299885 A1* 12/2011 Taba ..... 399/111

FOREIGN PATENT DOCUMENTS

JP 2006-263985 A 10/2006
JP 2008-286967 A 11/2008
JP 2008-286968 A 11/2008

* cited by examiner

*Primary Examiner* — Manish S Shah
*Assistant Examiner* — Yaovi Ameh
(74) *Attorney, Agent, or Firm* — Sughrue Mion, PLLC

(57) ABSTRACT

An image forming apparatus includes an image carrier that rotates; and an exposure unit that includes multiple light emitters, a holding unit, and first contact portions, the multiple light emitters being arranged along a rotation axis direction of the image carrier, the holding unit holding the multiple light emitters, the first contact portions being positioned on the holding unit so as to sandwich the multiple light emitters therebetween, the exposure unit exposing the image carrier to light. While the image carrier is being mounted on an apparatus body, the exposure unit is moved away from the image carrier in an optical axis direction of the exposure unit as a result of the first contact portions coming into contact with the image carrier, and the exposure unit and the image carrier are positioned as a result of the first contact portions coming into contact with the image carrier.

6 Claims, 15 Drawing Sheets

IMAGE FORMING APPARATUS AND EXPOSURE DEVICE

CROSS-REFERENCE TO RELATED APPLICATIONS

This application is based on and claims priority under 35 USC 119 from Japanese Patent Application No. 2013-029672 filed Feb. 19, 2013.

BACKGROUND

Technical Field

The present invention relates to image forming apparatuses and exposure devices.

SUMMARY

According to an aspect of the invention, an image forming apparatus includes an image carrier that rotates; and an exposure unit that includes multiple light emitters, a holding unit, and first contact portions, the multiple light emitters being arranged along a rotation axis direction of the image carrier, the holding unit holding the multiple light emitters, the first contact portions being positioned on the holding unit so as to sandwich the multiple light emitters therebetween, the exposure unit exposing the image carrier to light. While the image carrier is being mounted on an apparatus body, the exposure unit is moved away from the image carrier in an optical axis direction of the exposure unit as a result of the first contact portions coming into contact with the image carrier, and the exposure unit and the image carrier are positioned as a result of the first contact portions coming into contact with the image carrier.

BRIEF DESCRIPTION OF THE DRAWINGS

Exemplary embodiments of the present invention will be described in detail based on the following figures, wherein.

DETAILED DESCRIPTION

Figure 1:
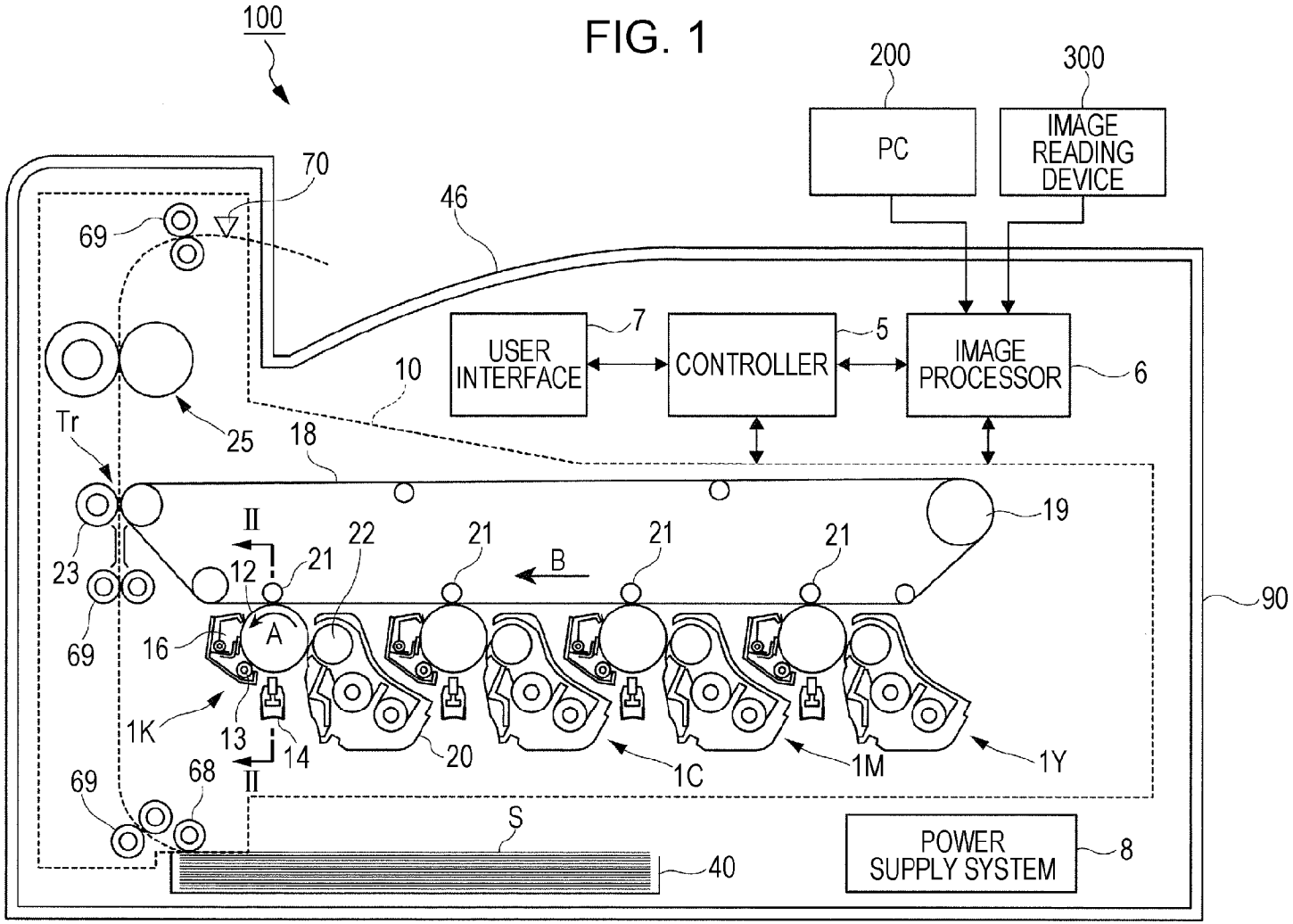
FIG. 1 is a schematic diagram of an image forming apparatus according to exemplary embodiments.

Referring to the drawings, exemplary embodiments of the present invention will be described in detail below.

Image Forming Apparatus 100

FIG. 1 is a schematic diagram of an image forming apparatus 100 according to exemplary embodiments. The image forming apparatus 100 illustrated in FIG. 1 is a so-called tandem color printer. The image forming apparatus 100 includes an image forming section 10, which forms images in accordance with image data for different colors. The image forming apparatus 100 also includes a controller 5, an image processor 6, and a user interface 7. The controller 5 controls operations of the image forming apparatus 100 as a whole. The image processor 6 is connected with an external device such as a personal computer (PC) 200 or an image reading device 300 and performs predetermined image processing on image data transmitted from the external device. The user interface 7 receives commands given by users' operations. The image forming apparatus 100 also includes a power supply system 8, which supplies power to each component. The image forming apparatus 100 also includes a sheet container 40, which contains sheets S that are to be fed to the image forming section 10, and an ejected-sheet holder 46, which holds sheets S on which images have been formed by the image forming section 10.

In the exemplary embodiments, the image forming apparatus 100 is described as a so-called tandem color printer but the present invention is not limited to this. For example, the image forming apparatus 100 may be a so-called multi-path (four cycle) color printer.

Image Forming Section 10

The image forming section 10 includes four image forming units 1Y, 1M, 1C, and 1K, which are arranged side by side with certain intervals therebetween. Each of the image forming units 1Y, 1M, 1C, and 1K includes a photoconductor drum 12, on which an electrostatic latent image is formed and which carries a toner image, a charging device 13, which uniformly charges the surface of the photoconductor drum 12 at a predetermined potential, an LED print head (LPH) 14, which exposes the photoconductor drum 12 charged by the charging device 13 to light on the basis of image data to form an electrostatic latent image, and a developing device 20, which develops the electrostatic latent image formed on the photoconductor drum 12 with a developer. Each of the image forming units 1Y, 1M, 1C, and 1K further includes a cleaner 16 that cleans the surface of the photoconductor drum 12 subjected to a transfer operation.

The image forming units 1Y, 1M, 1C, and 1K have the same configuration except for toners contained in the corresponding developing devices 20. The image forming units 1Y, 1M, 1C, and 1K respectively form toner images of yellow (Y), magenta (M), cyan (C), and black (K). For this reason, components of the image forming units 1Y, 1M, 1C, and 1K are distinguished from one another by adding characters of "Y", "M", "C", and "K" in the following description, but these characters are not added to these components when the components do not need to be distinguished from one another. For example, when the developing device of the image forming unit 1Y is to be distinguished, the developing device is written as a "developing device 20Y", whereas the developing device is written as a "developing device 20" if the developing device 20Y does not need to be distinguished from the developing devices 20M, 20C, and 20K. Similarly, when the image forming unit for yellow is to be distinguished, the image forming unit is written as an "image forming unit 1Y", whereas the image forming unit is written as an "image forming unit 1" when the image forming unit does not need to be distinguished from the image forming units 1M, 1C, and 1K.

The image forming section 10 includes an intermediate transfer belt 18, a driving roller 19, first transfer rollers 21, a second transfer roller 23, and a fixing device 25. The intermediate transfer belt 18 is one to which color toner images formed by the photoconductor drums 12 of the image forming units 1 are transferred in a stacked manner. The driving roller 19 rotates the intermediate transfer belt 18. The first transfer rollers 21 sequentially transfer (first transfer) the color toner images formed by the image forming units 1 to the intermediate transfer belt 18. The second transfer roller 23 collectively transfers (second transfers) the color toner images formed on the intermediate transfer belt 18 in a stacked manner to a sheet S. The fixing device 25 fixes the second-transferred color toner images to the sheet S.

The image forming section 10 also includes a pickup roller 68 and transporting rollers 69. The pickup roller 68 picks up sheets S loaded in the sheet container 40 one after another. The transporting rollers 69 transport the sheets S picked up by the pickup roller 68. The image forming section 10 also includes an exit sensor 70 that detects when a sheet S to which toner images have been fixed by the fixing device 25 passes thereby. These components are disposed in a housing 90.

In the image forming apparatus 100 according to the exemplary embodiments, image data input through the PC 200 or the image reading device 300 is subjected to predetermined image processing by the image processor 6 and then transmitted to each image forming unit 1 via an interface, not illustrated. Thereafter, for example, in the image forming unit 1K that forms a black (K) toner image, the photoconductor drum 12 is uniformly charged by the charging device 13 at a predetermined potential while rotating in the direction of the arrow A in FIG. 1, and is scanned and exposed to light by the LPH 14 on the basis of the image data transmitted from the image processor 6. Thus, an electrostatic latent image for a black (K) image is formed on the photoconductor drum 12. The electrostatic latent image formed on the photoconductor drum 12 is developed by the developing device 20 at a developing position at which the photoconductor drum 12 and the developing device 20 face each other, thereby forming a black (K) toner image on the photoconductor drum 12. Each of the image forming units 1Y, 1M, and 1C similarly forms a toner image of the corresponding color of yellow (Y), magenta (M), or cyan (C).

The toner images of the corresponding colors formed by the image forming units 1 are sequentially and electrostatically sucked by the first transfer rollers 21 and transferred to the surface of the intermediate transfer belt 18 that moves in the direction of the arrow B in FIG. 1, thereby forming a superposed toner image in which toner images of different colors are superposed on top of one another. The superposed toner image on the intermediate transfer belt 18 is transported to a portion (second transfer portion Tr) in which the second transfer roller 23 is disposed as the intermediate transfer belt 18 moves.

Meanwhile, the sheets S loaded in the sheet container 40 are picked up by the pickup roller 68. Each sheet S picked up by the pickup roller 68 is fed to the second transfer portion Tr by the transporting rollers 69 at the timing when the superposed toner image is transported to the second transfer portion Tr. The superposed toner image is electrostatically transferred as a whole to the sheet S that has been transported to the second transfer portion Tr by the transporting rollers 69 with an effect of a transfer electric field formed by the second transfer roller 23.

The sheet S to which the superposed toner image has been electrostatically transferred is separated from the intermediate transfer belt 18 and transported to the fixing device 25. The toner image on the sheet S transported to the fixing device 25 is subjected to a fixing operation with heat and pressure by the fixing device 25 and thus fixed to the sheet S. The sheet S to which the image is fixed is further transported by the transporting rollers 69. After being detected by the exit sensor 70, the sheet S is ejected to the ejected-sheet holder 46 and stacked on other sheets S.

In this manner, the image forming apparatus 100 repeats the image formation cycle as many times as the number of sheets to be printed.

Photoconductor Drum 12 and LPH 14

Figure 2:
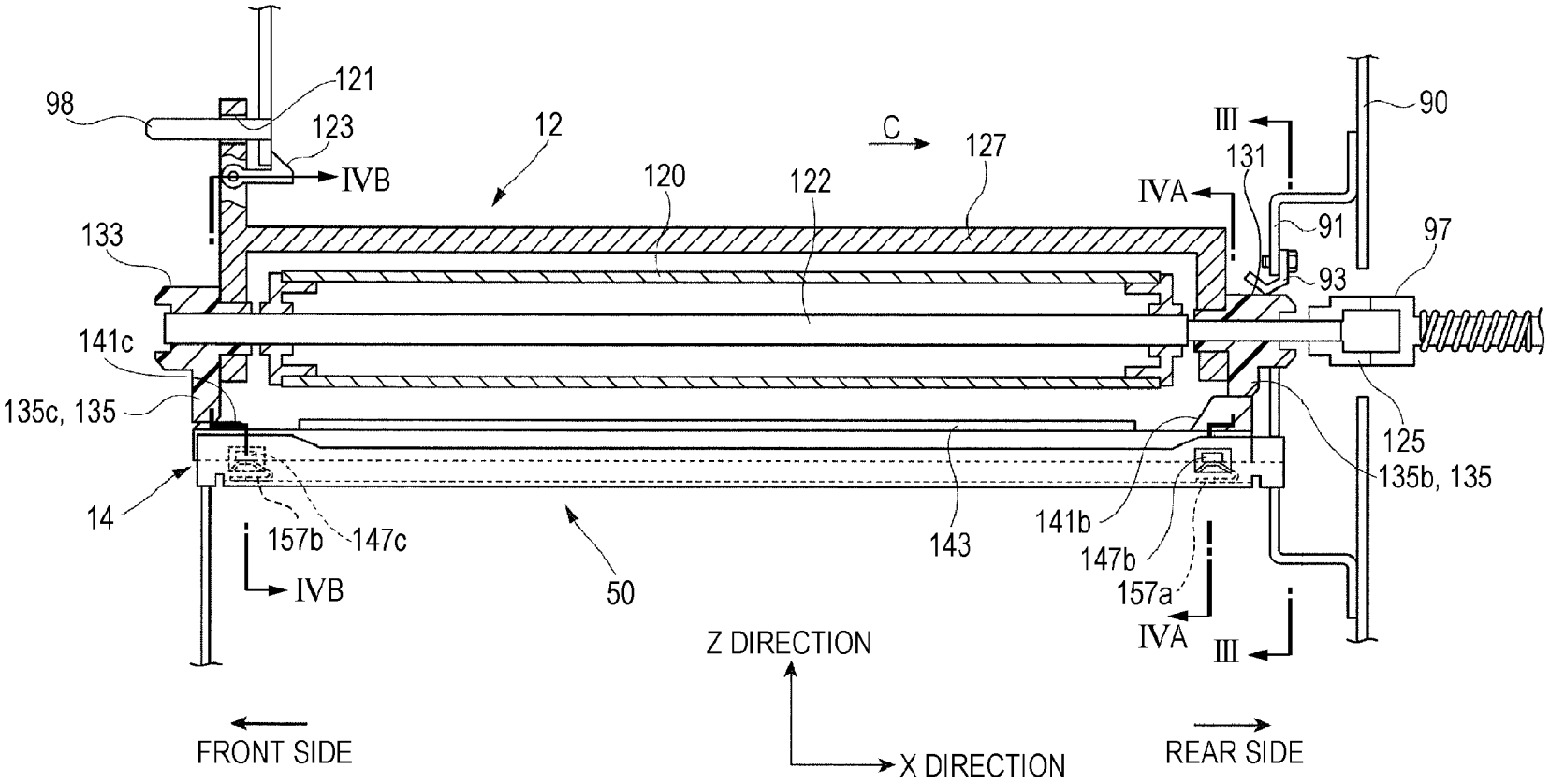
FIG. 2 is a schematic diagram of surroundings of a photoconductor drum and an LPH according to a first exemplary embodiment.

Referring now to FIG. 2, configurations of the photoconductor drum 12 and the LPH 14 will be described. FIG. 2 is a schematic diagram of the surroundings of one photoconductor drum 12 and the corresponding LPH 14 according to a first exemplary embodiment and is a cross-sectional view taken along the line II-II in FIG. 1.

As illustrated in FIG. 2, the photoconductor drum 12 and the LPH 14 are supported by the housing 90. Here, the photoconductor drum 12 is attachable to and detachable from the housing 90. Specifically, the photoconductor drum 12 is inserted in the axis direction of the photoconductor drum 12 (see the arrow C in FIG. 2) and disposed in the housing 90. The image forming apparatus 100 according to the exemplary embodiment has a mechanism that guides the LPH 14 to a predetermined position as a result of the photoconductor drum 12 pressing the LPH 14 in the optical axis direction of the LPH 14 as the photoconductor drum 12 is inserted.

In the following description, the longitudinal direction (main scan direction) of the LPH 14 is defined as an X direction, the optical axis direction of light that travels from the LPH 14 to the photoconductor drum 12 (light emission direction) is defined as a Z direction, and the direction that is perpendicular to the X and Z directions is defined as a Y direction. In addition, the left side of FIG. 2 in the X direction is defined as a front side and the right side of FIG. 2 in the X direction is defined as a rear side.

Figure 3:
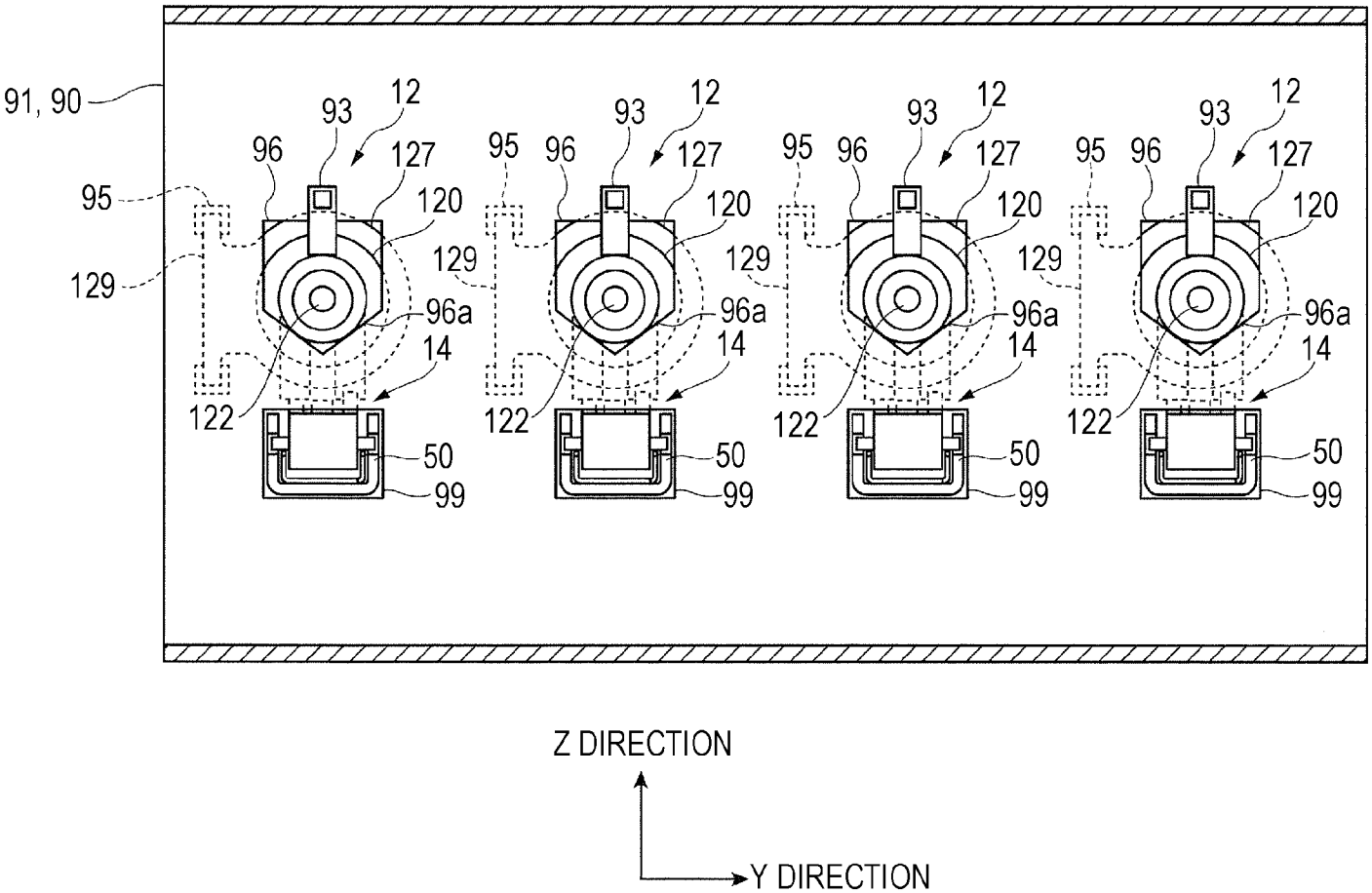
FIG. 3 is a cross-sectional view taken along the line III-III in FIG. 2.

Referring now to FIGS. 2 and 3, surroundings of the photoconductor drum 12 and the LPH 14 will be described. FIG. 3 is a cross-sectional view taken along the line III-III in FIG. 2.

As illustrated in FIG. 2, the housing 90, which is an example of a supporting member, includes a supporting plate 91 that supports the photoconductor drums 12 and the LPHs 14 on its rear side. The housing 90 includes housing-side couplings 97 at positions at which the housing-side couplings 97 face the tips of the photoconductor drums 12 supported by the supporting plate 91. Each housing-side coupling 97 supplies driving force fed from a motor (not illustrated) to the photoconductor drum 12.

The housing 90 also includes flat springs 93, which urge rear end portions of the photoconductor drums 12 toward the corresponding LPHs 14 (downward in FIG. 2), and guide rails 95 (see FIG. 3), whose longitudinal direction extends in the X direction and which guide the photoconductor drums 12 in the direction in which the photoconductor drums 12 are inserted.

As illustrated in FIG. 3, the supporting plate 91 of the housing 90 has photoconductor-drum supporting holes 96, into which rear end portions of the photoconductor drums 12 are inserted, and frame supporting holes 99, into which rear end portions of frames 50 supporting the LPHs 14 are inserted. The frames 50 will be described below.

The LPH-14 side of each photoconductor-drum supporting hole 96 in the Z direction is formed into a V shape. Specifically, each photoconductor-drum supporting hole 96 has a tapered portion 96*a* in which the width in the Y direction is tapered toward the LPH 14 in the Z direction. When the photoconductor drum 12 is pressed against the tapered portion 96*a* by the urging force of the flat spring 93, the photoconductor drum 12 becomes immobile in the Z direction and in the Y direction.

An end portion of each frame 50 is fitted into the corresponding frame supporting hole 99 and fixed to the supporting plate 91 by welding or by other ways. On the other hand, each LPH 14 held in the corresponding frame 50 is movable in the Z direction (this configuration will be described in detail below). The frame 50 and the housing 90 may be regarded as an apparatus body.

Figure 4B:
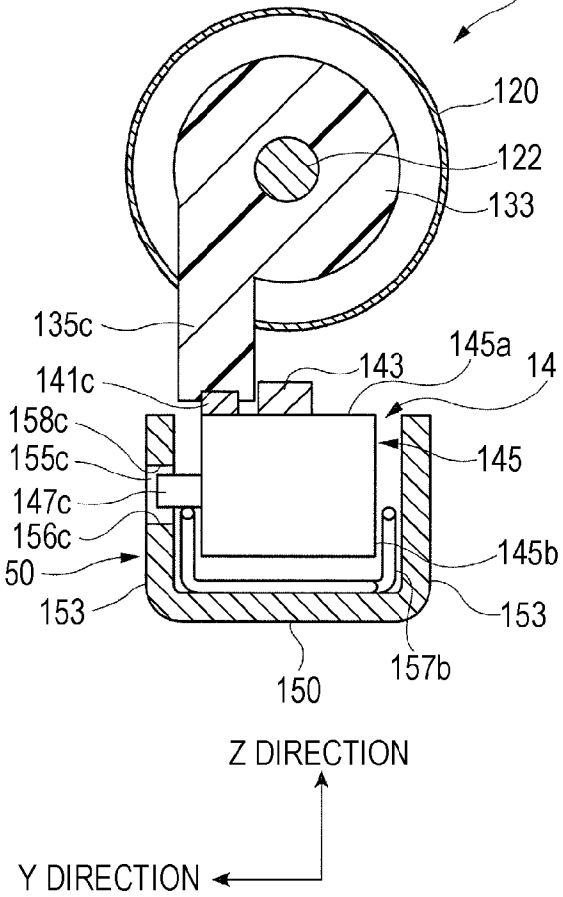
FIGS. 4A and 4B illustrate a positional relationship between the photoconductor drum and the LPH.
Figure 4A:
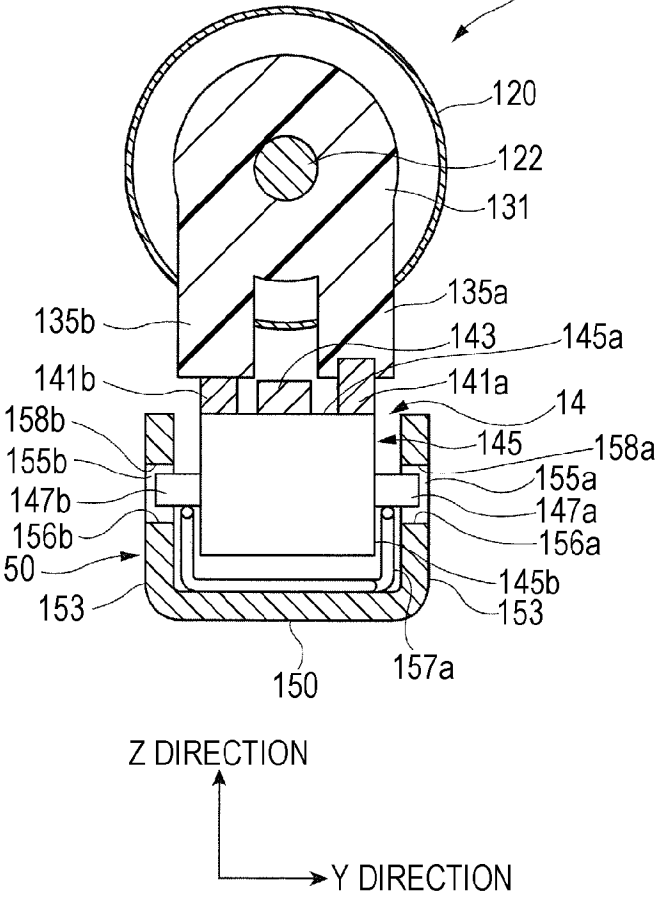

Referring now to FIGS. 4A and 4B, the positional relationship between the photoconductor drum 12 and the LPH 14 will be described. FIGS. 4A and 4B illustrate the positional relationship between the photoconductor drum 12 and the LPH 14. More specifically, FIG. 4A is a cross-sectional view taken along the line IVA-IVA in FIG. 2 and FIG. 4B is a cross-sectional view taken along the line IVB-IVB in FIG. 2. In FIGS. 4A and 4B, a covering member 127 of the photoconductor drum 12 (to be described below) is omitted.

As illustrated in FIGS. 4A and 4B, in the exemplary embodiment, when the photoconductor drum 12 and the LPH 14 come into contact with each other in the Z direction, the position of the LPH 14 with respect to the photoconductor drum 12 in the Z direction is determined. More specifically, when the photoconductor drum 12 and the LPH 14 come into contact with each other, the distance from a rod lens array 143 (to be described below) of the LPH 14 to the surface of a photoconductor drum body 120 (to be described below) is fixed.

The photoconductor drum 12 and the LPH 14 are in contact with each other at two points (see FIG. 4A) on the rear side and at one point (see FIG. 4B) on the front side. Here, as long as the photoconductor drum 12 and the LPH 14 are in contact with each other on both rear and front sides, they may be in contact at one point on the rear side and at one point on the front side or at one point on the rear side and at two points on the front side. When the photoconductor drum 12 supports the LPH 14 at three points that are not on a straight line (triangularly supports the LPH 14) as illustrated in FIGS. 4A and 4B, the LPH 14 is more stably positioned with respect to the photoconductor drum 12 than in the case where the photoconductor drum 12 supports the LPH 14 at two points or less or four points or more.

LPH 14

Figure 5A:
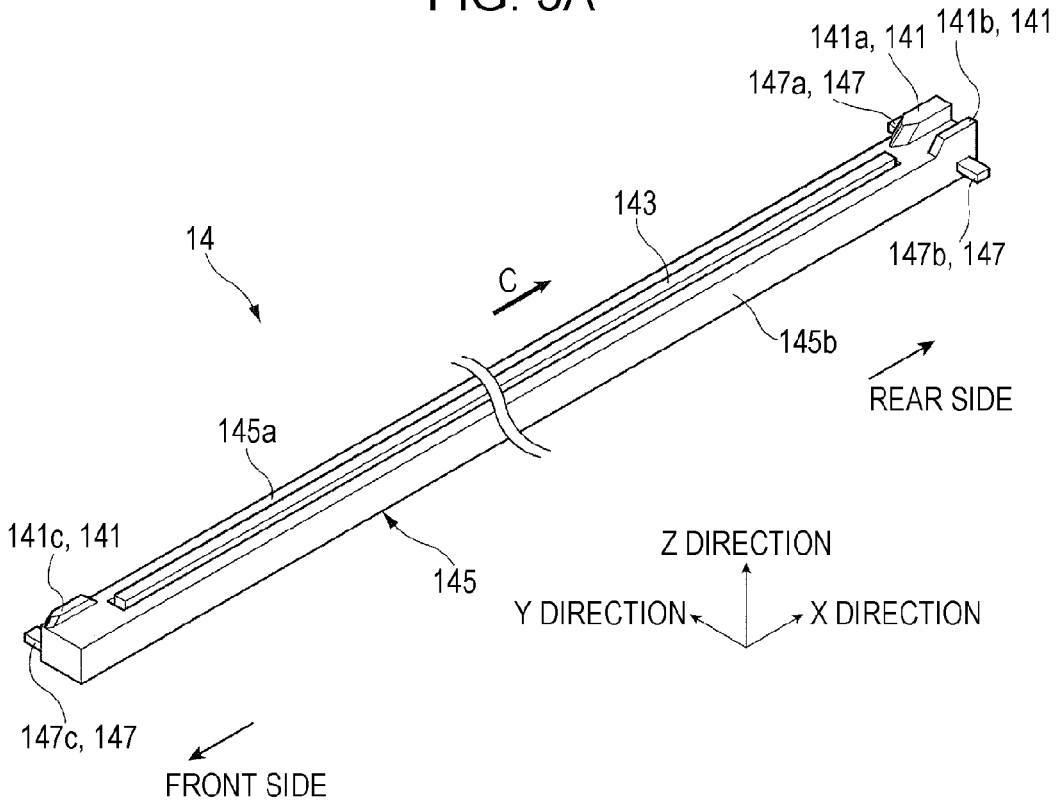
FIGS. 5A and 5B are schematic diagrams of the LPH.
Figure 5B:
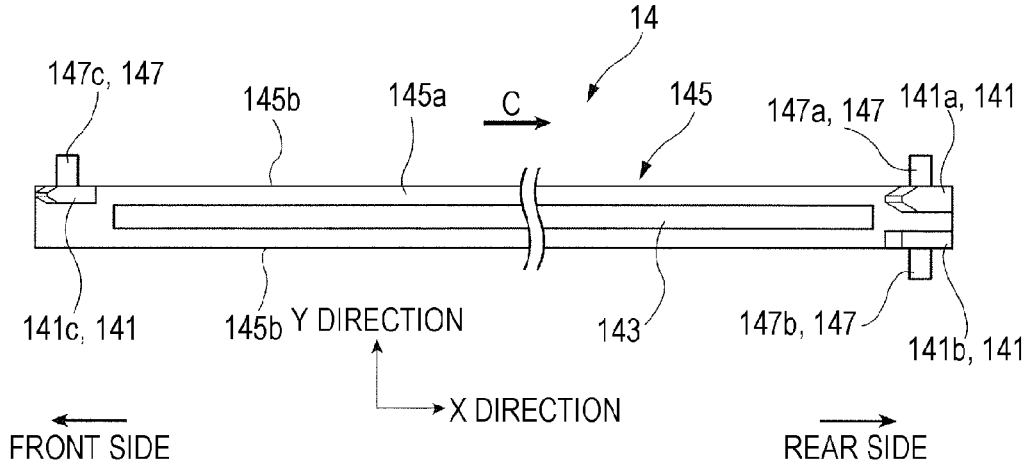

Referring now to FIGS. 5A and 5B, a configuration of the LPH 14 will be described. FIGS. 5A and 5B are schematic diagrams of the LPH 14. More specifically, FIG. 5A is a perspective view of the LPH 14 and FIG. 5B is a top view of the LPH 14.

The LPH 14, which is an example of an exposure unit, includes a light-emitting chip array 146 (see FIG. 7A to be described below), a circuit board 142, on which the light-emitting chip array 146 is disposed (see FIG. 7A), and a rod lens array 143, which causes light emitted from the light-emitting chip array 146 to be imaged on the surface of the photoconductor drum body 120 (see FIG. 2).

The LPH 14 supports the circuit board 142 and the rod lens array 143 and includes a resin-made holder 145 that shields the light-emitting chip array 146 disposed on the circuit board 142 from outside. Here, the holder 145 includes a top surface 145*a*, on which the rod lens array 143 is disposed, and side surfaces 145*b* extending in the longitudinal direction of the holder 145.

The holder (holding unit) 145 includes multiple ribs (first contact portions or guide portions) 141, which protrude in the Z direction from the top surface 145*a* at both end portions in the X direction. Specifically, as illustrated in FIG. 5A, the holder 145 includes a first rib 141*a* and a second rib 141*b* on the rear side and a third rib 141*c* on the front side.

As illustrated in FIG. 5B, the first rib 141*a* and the third rib 141*c* are formed on one side-surface-145*b* side of the holder 145 (upper side in FIG. 5B).

The holder 145 also includes supportable portions 147, which protrude from the side surfaces 145*b* in the Y direction. Specifically, as illustrated in FIG. 5B, a first supportable portion 147*a* to a third supportable portion 147*c* are formed at positions corresponding to the first rib 141*a* to the third rib 141*c*. More specifically, the first supportable portion 147*a* to the third supportable portion 147*c* are respectively positioned so as to overlap the first rib 141*a* to the third rib 141*c* in the X direction. For this reason, when the first supportable portion 147*a* to the third supportable portion 147*c* are pressed in the Z direction (to be described in detail below), thick portions of the holder 145 having large thicknesses in the Z direction receive pressure, thereby preventing the holder 145 from bending.

Figure 6A:
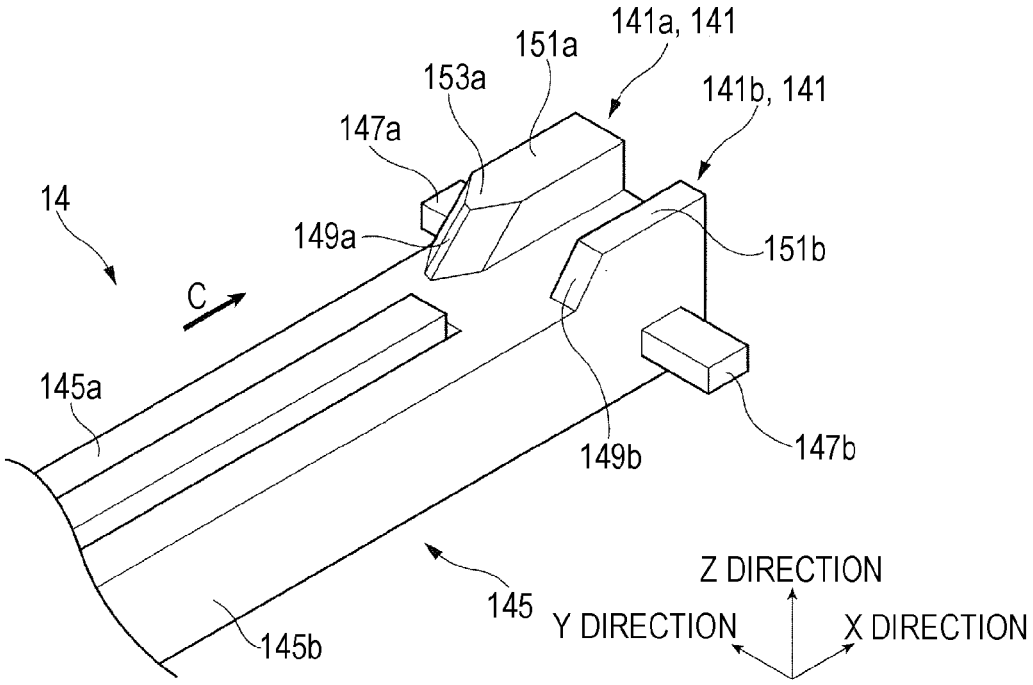
FIGS. 6A and 6B are schematic diagrams of ribs.
Figure 6B:
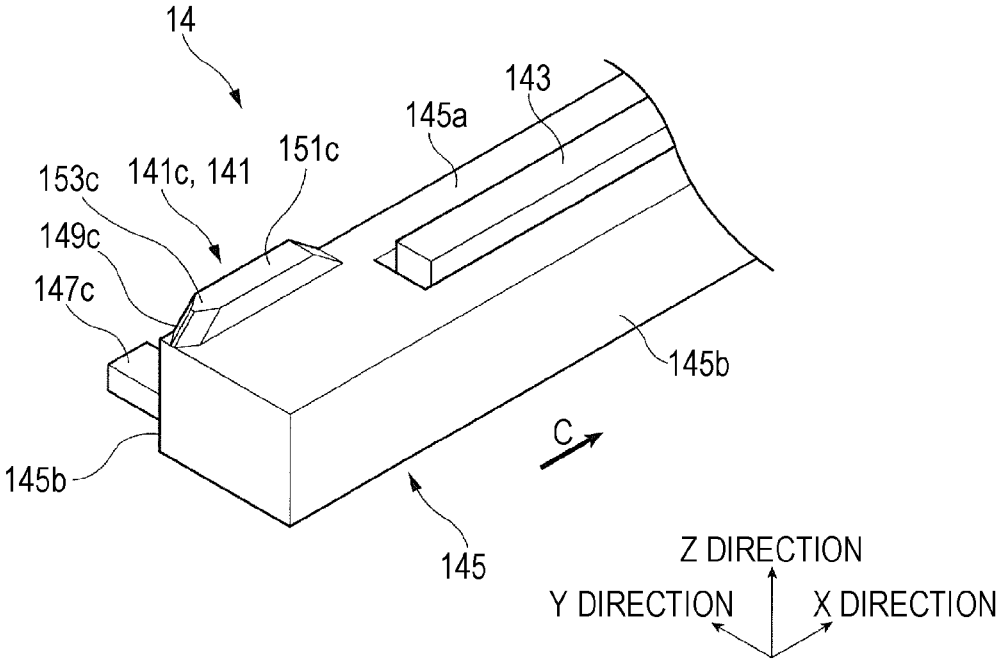

Referring now to FIGS. 6A and 6B, a configuration of the ribs 141 will be described. FIGS. 6A and 6B illustrate a configuration of the ribs 141. Specifically, FIG. 6A is a perspective view of the rear side of the LPH 14 and FIG. 6B is a perspective view of the front side of the LPH 14.

The first rib 141*a* to the third rib 141*c* respectively include inclined surfaces 149*a* to 149*c*, which are inclined so as to become increasingly separated from the top surface 145*a* as they extend from an upstream side to a downstream side in a direction in which the photoconductor drum 12 is inserted (see the arrow C and this direction is hereinafter referred to as insertion direction). The first rib 141*a* to the third rib 141*c* also have top surfaces 151*a* to 151*c*, respectively, which face the photoconductor drum 12. The first rib 141*a* and the third rib 141*c* respectively include tapered portions 153*a* and 153*c* at their upstream end portions in the insertion direction. The width of each of the tapered portions 153*a* and 153*c* in the Y direction is tapered from the downstream side to the upstream side in the insertion direction.

The first rib 141*a* and the second rib 141*b* are separated from each other in the Y direction. The height of the first rib 141*a* from the top surface 145*a* of the holder 145 is larger than the height of the second rib 141*b*. In addition, the heights of the first rib 141*a* and the second rib 141*b* from the top surface 145*a* are larger than the height of the third rib 141*c*.

Figure 7A:
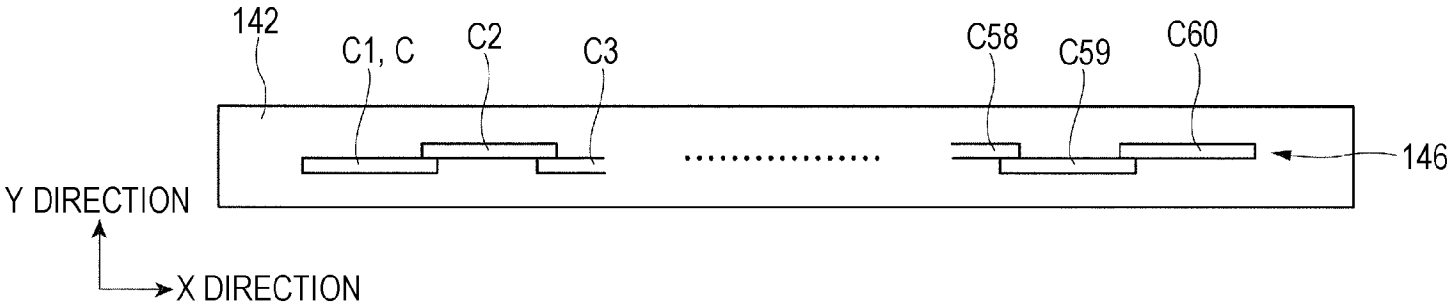
FIGS. 7A and 7B illustrate optical members included in the LPH.
Figure 7B:
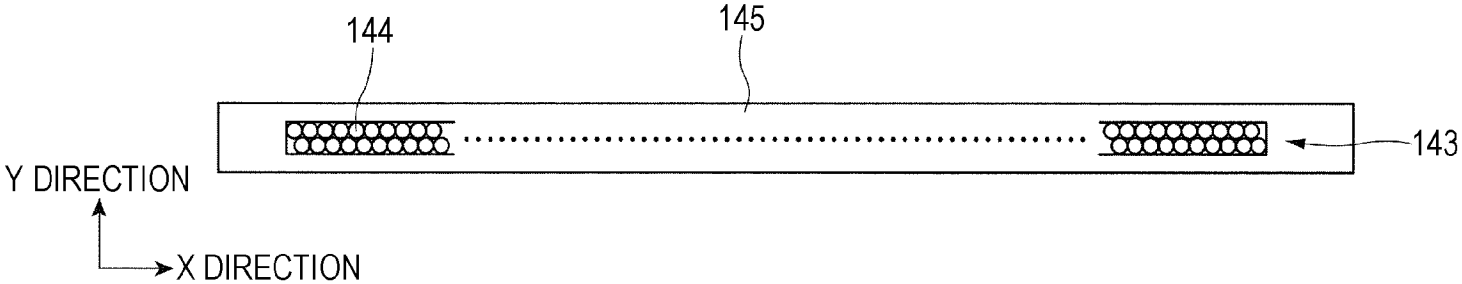

Referring now to FIGS. 7A and 7B, optical members included in the LPH 14 will be described. FIGS. 7A and 7B illustrate the optical members included in the LPH 14. Specifically, FIG. 7A is a top view of the light-emitting chip array 146 of the LPH 14 and FIG. 7B is a top view of the rod lens array 143 and the holder 145 of the LPH 14.

As illustrated in FIG. 7A, the light-emitting chip array 146 includes 60 light emitting chips C (C1 to C60), which are examples of emitters, including multiple LEDs, the chips C being arranged in a so-called staggered manner in two rows arranged side by side in the Y direction. The number of emitters, however, may be appropriately determined in accordance with a desired exposure width in the main scan direction.

As illustrated in FIG. 7B, the rod lens array 143 includes multiple rod lenses 144 alternately arranged in two rows side by side in the Y direction, the rod lenses 144 being held on the holder 145. Each rod lens 144 is, for example, a graded index lens, which has a cylindrical shape, has a refractive index distribution in the radial direction, and forms erect one-to-one images. Examples of a graded index lens include SELFOC (registered trademark).

Frame 50

Figure 8A:
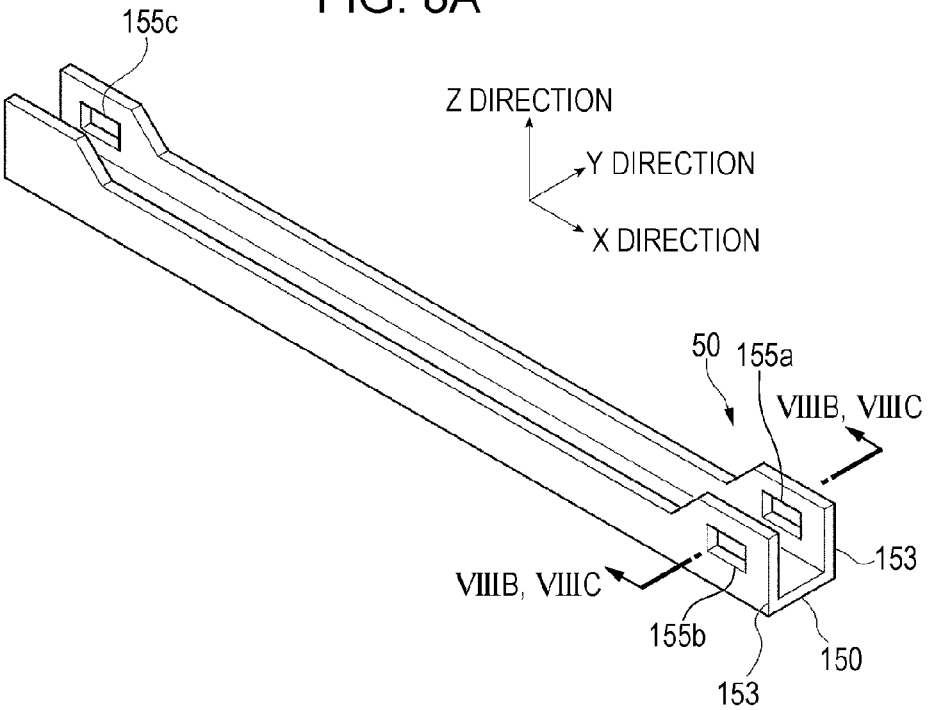
FIGS. 8A to 8C are schematic diagrams of a frame.
Figure 8B:
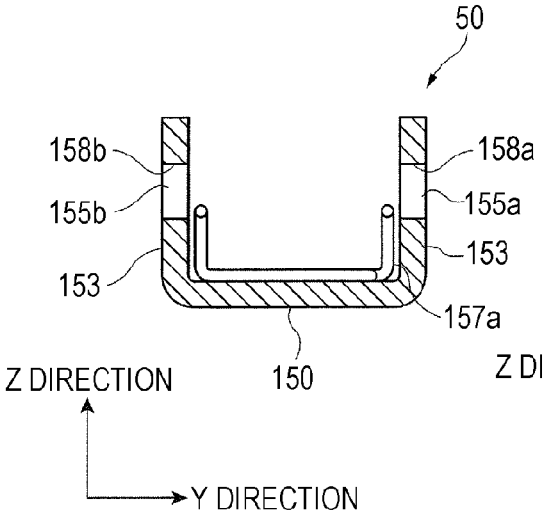
Figure 8C:
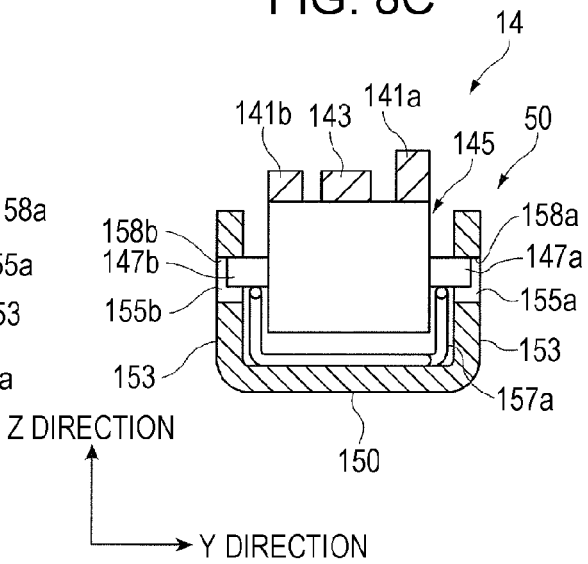

Referring now to FIGS. 8A to 8C, a configuration of a frame 50 will be described. FIGS. 8A to 8C illustrate a configuration of the frame 50. Specifically, FIG. 8A is a perspective view of the frame 50, FIG. 8B is a cross-sectional view taken along the line VIIIB-VIIIB in FIG. 8A, and FIG. 8C is a cross-sectional view taken along the line VIIIC-VIIIC in FIG. 8A when the LPH 14 is mounted on the frame 50.

As illustrated in FIG. 8A, the frame 50 is a member having a substantially U-shaped cross section and whose longitudinal direction coincides with the X direction. Both ends of the frame 50 in the X direction are supported by the housing 90. The frame 50 includes a base portion 150 and side portions 153 on both sides of the base portion 150. A first through-hole 155*a* to a third through-hole 155*c*, into which the first supportable portion 147*a* to the third supportable portion 147*c* (see FIGS. 6A and 6B) of the LPH 14 are inserted, are formed in the side portions 153.

As illustrated in FIG. 8B, the frame 50 includes a first spring member 157*a* and a second spring member 157*b* (see FIG. 4B) at such positions as to correspond to the first through-hole 155*a* to the third through-hole 155*c* in the X direction. The first spring member 157*a* and the second spring member 157*b* (pressing unit) apply an urging force to the LPH 14 in such a direction that the LPH 14 is separated from the base portion 150 in the Z direction.

As illustrated in FIG. 8C, the frame 50 is placed such that the LPH 14 is inserted into the U-shaped inner space of the frame 50 and such that the frame 50 covers the LPH 14 from the side opposite to a side facing the photoconductor drum 12. When the LPH 14 is disposed in the inner space of the frame 50, the first supportable portion 147*a* to the third supportable portion 147*c* are in the state of being inserted into the first through-hole 155*a* to the third through-hole 155*c*.

Here, the dimension of each of the first through-hole 155*a* to the third through-hole 155*c* in the Z direction is determined such that the corresponding one of the first supportable portion 147*a* to the third supportable portion 147*c* inserted into itself is movable in the Z direction and such that the frame 50 is not in contact with the corresponding one of the first supportable portion 147*a* to the third supportable portion 147*c* in the state where the position of the LPH 14 with respect to the photoconductor drum 12 is fixed (to be described in detail, below).

In the example illustrated in FIGS. 4A and 4B, the first spring member 157*a* presses the first supportable portion 147*a* and the second supportable portion 147*b* and the second spring member 157*b* presses the third supportable portion 147*c*, so that the LPH 14 is urged toward the photoconductor drum 12 (in the Z direction).

Here, when the LPH 14 is in the state of not being pressed by the photoconductor drum 12, the position of the LPH 14 in the Z direction is temporarily determined as a result of the first supportable portion 147*a* to the third supportable portion 147*c* respectively coming into contact with a first ceiling portion 158*a* to a third ceiling portion 158*c*.

Photoconductor Drum 12

Figure 9A:
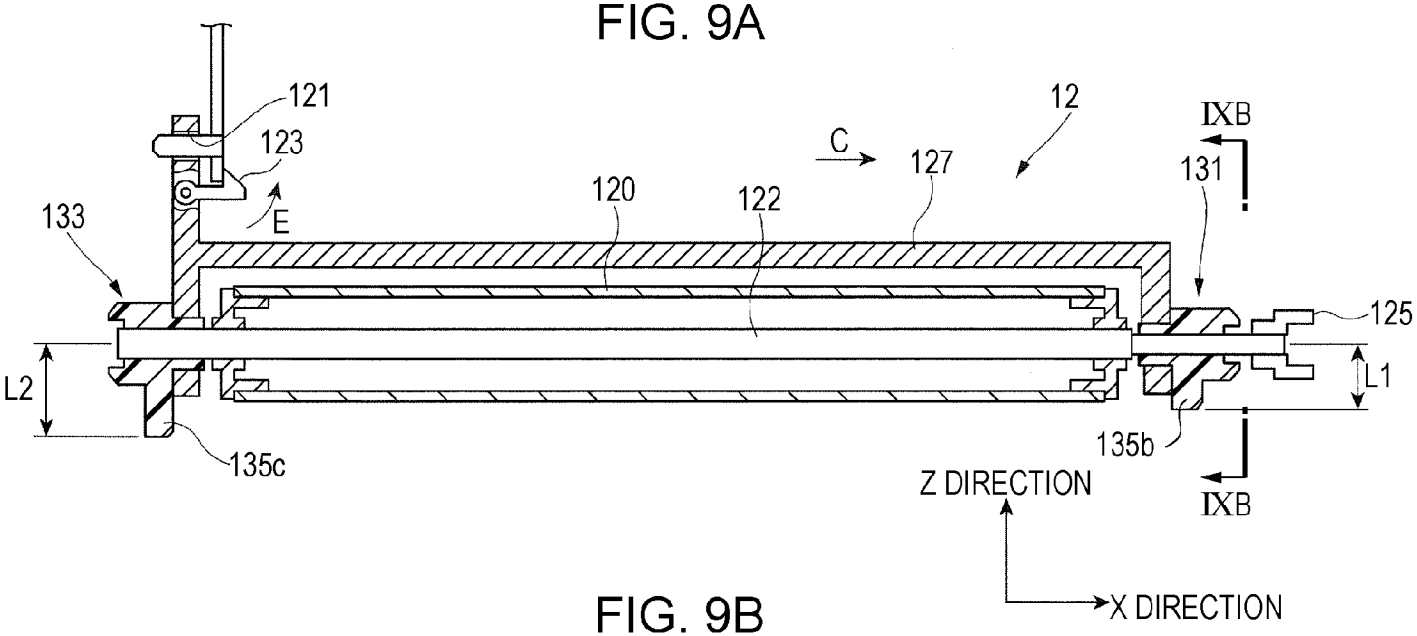
FIGS. 9A and 9B are schematic diagrams of the photoconductor drum.
Figure 9B:
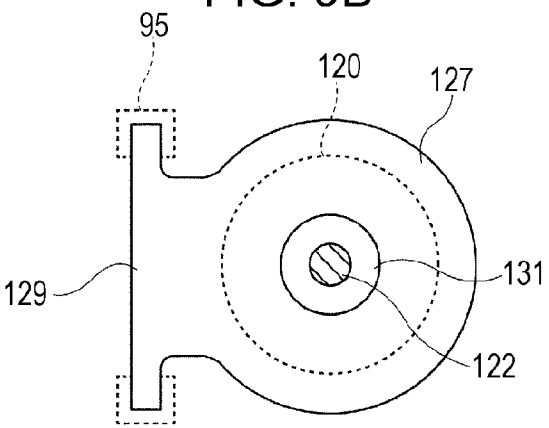

Referring now to FIGS. 9A and 9B, a configuration of the photoconductor drum 12 will be described. FIGS. 9A and 9B illustrate a configuration of the photoconductor drum 12. Specifically, FIG. 9A is a cross-sectional view taken along the rotation axis of the photoconductor drum 12 and FIG. 9B is a cross-sectional view taken along the line IXB-IXB in FIG. 9A.

Each photoconductor drum 12, which is an example of an image carrier, includes a photoconductor drum body 120 and a shaft 122, which is a rotation shaft of the photoconductor drum body 120. An electrostatic latent image is formed on a surface of the photoconductor drum body 120 by the LPH 14 and the photoconductor drum body 120 holds a toner image. Each photoconductor drum 12 also includes a photoconductor-drum side coupling 125 and a covering member 127, which covers the photoconductor drum body 120. The photoconductor-drum side coupling 125 receives driving force from the housing 90 at the downstream end portion in the insertion direction (see the arrow C in FIG. 9A). The photoconductor drum 12 also includes a rear bearing 131 and a front bearing 133, which rotatably support the shaft 122 at both ends of the shaft 122 in the X direction. The positions of the rear bearing 131 and the front bearing 133 in a direction perpendicular to the rotation axis are determined relative to the photoconductor drum body 120.

Each covering member 127 has a positioning hole 121 on an upstream side in the insertion direction (see the arrow C in FIG. 9A), the positioning hole 121 extending in the X direction. The covering member 127 also includes a hook 123, which becomes engaged with the housing 90 when the photoconductor drum 12 is inserted into the housing 90. The hook 123 is urged by a spring member, not illustrated, in the direction of the arrow E in FIG. 9A. As illustrated in FIG. 9B, the covering member 127 also includes a guided portion 129, which is guided by the guide rails 95.

Figure 10A:
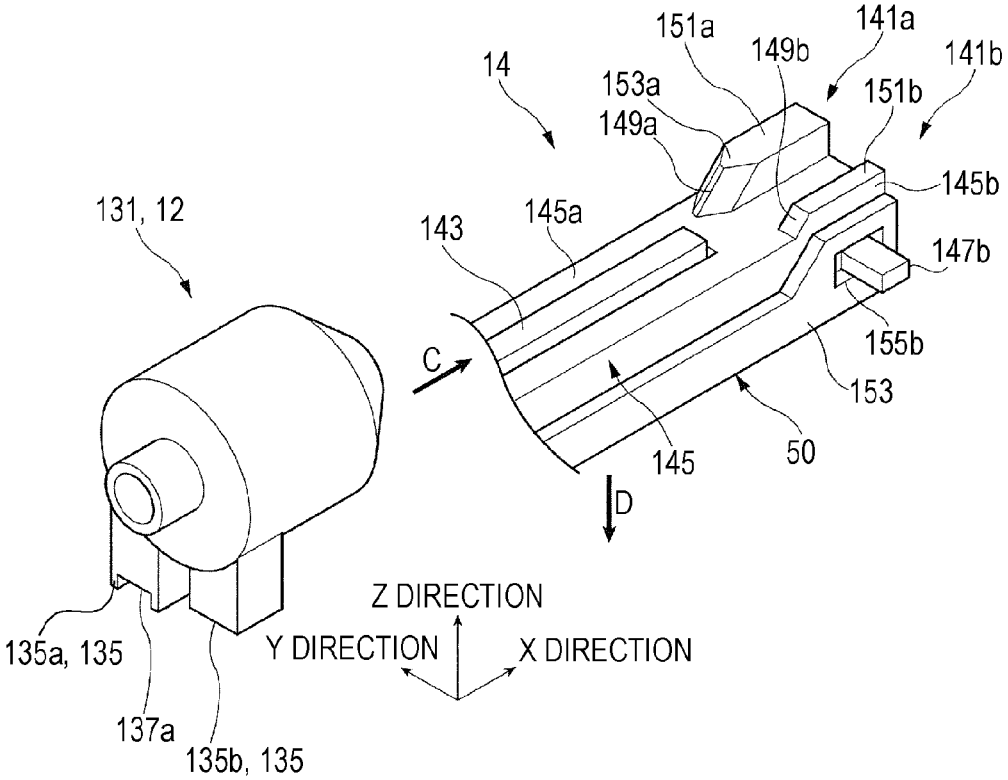
FIGS. 10A and 10B are schematic diagrams of a rear bearing and a front bearing.
Figure 10B:
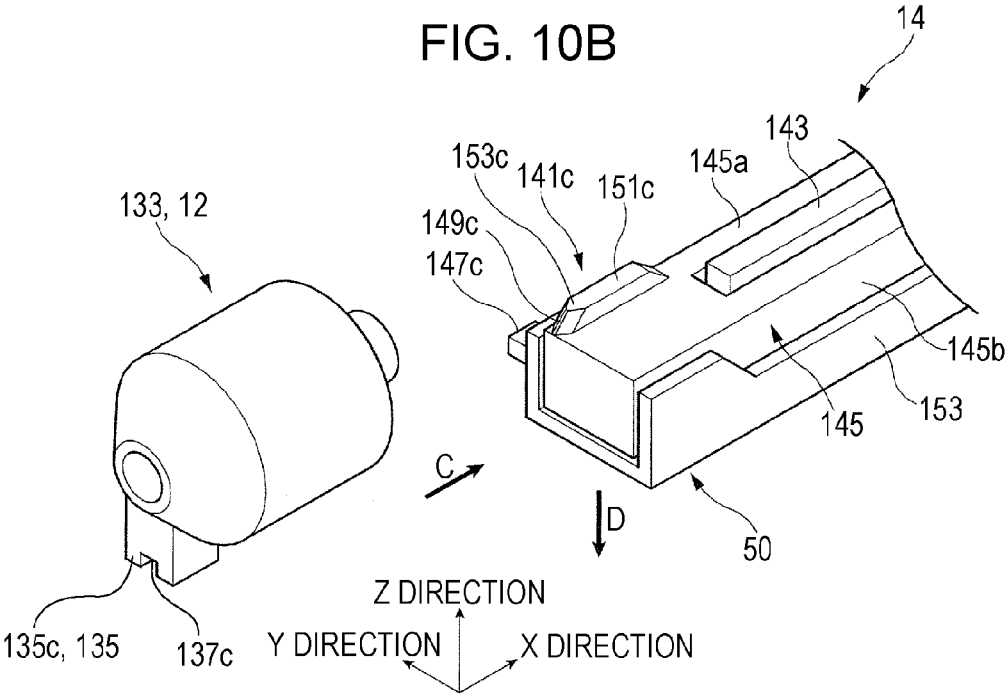

Referring now to FIGS. 9A, 9B, 10A, and 10B, configurations of the rear bearing 131 and the front bearing 133 will be described. FIGS. 10A and 10B illustrate schematic configurations of the rear bearing 131 and the front bearing 133. Specifically, FIG. 10A is a perspective view of components such as the rear bearing 131 and the LPH 14 and FIG. 10B is a perspective view of components such as the front bearing 133 and the LPH 14.

The rear bearing 131 and the front bearing 133 are made of resin and includes contact portions (second contact portions) 135, which protrude toward the LPH 14 and come into contact with the LPH 14. Specifically, as illustrated in FIG. 10A, the rear bearing 131 includes a first bearing-side contact portion 135*a* and a second bearing-side contact portion 135*b*, which are separated from each other in the Y direction. As illustrated in FIG. 10B, the front bearing 133 includes a third bearing-side contact portion 135*c*.

The first bearing-side contact portion 135*a* has a groove 137*a* that extends in the X direction. The width of the groove 137*a* in the Y direction corresponds to the width of the first rib 141*a* in the Y direction. Similarly, the third bearing-side contact portion 135*c* has a groove 137*c* that extends in the X direction. The width of the groove 137*c* in the Y direction corresponds to the width of the third rib 141*c* in the Y direction.

The first bearing-side contact portion 135*a* and the third bearing-side contact portion 135*c* are formed on one side portion of the photoconductor drum 12 in the Y direction.

The heights of the first bearing-side contact portion 135*a* and the second bearing-side contact portion 135*b*, which are the contact portions 135 on the rear side, from the shaft 122 (see L1 in FIG. 9A) are smaller than the height of the third bearing-side contact portion 135*c* (see L2 in FIG. 9A), which is the contact portion 135 on the front side. For this reason, when the photoconductor drum 12 is inserted into the housing 90, the contact portions 135 formed on the rear side of the photoconductor drum 12 are prevented from coming into contact with components such as the rod lens array 143 and thus prevented from damaging the LPH 14.

Operation of Inserting Photoconductor Drum 12

Referring now to FIGS. 2, 3, 4A, 4B, 10A, and 10B, an operation of inserting a photoconductor drum 12 into the housing 90 will be described.

First, a LPH 14 and a frame 50 are inserted into the housing 90. Here, the LPH 14 and the frame 50 may be regarded as an exposure device. Then, as the guided portion 129 of the photoconductor drum 12 is guided by the guide rails 95, the photoconductor drum 12 enters the housing 90 (see the arrow C in the drawings) while the orientation of the photoconductor drum 12 remain unchanged. Thereafter, the first bearing-side contact portion 135*a* of the photoconductor drum 12 comes into contact with the first rib 141*a* of the LPH 14 positioned so as to protrude into a passage (insertion passage) along which the photoconductor drum 12 enters the housing 90.

At this time, the first bearing-side contact portion 135*a* is moved along the inclined surface 149*a* of the first rib 141*a* and rises to the top surface 151*a* of the first rib 141*a* while an impact (damage) exerted on the LPH 14 is kept low. While the first bearing-side contact portion 135*a* is in the state of rising to the top surface 151*a*, the first bearing-side contact portion 135*a* moves the first rib 141*a* by applying a force to the first rib 141*a* in a direction away from itself in the Z direction (see the arrow D in the drawings). Thus, the position of the LPH 14 with respect to the photoconductor drum 12 is fixed. The position of the LPH 14 is an example of a predetermined position of the exposure unit.

Similarly, the second bearing-side contact portion 135*b* and the third bearing-side contact portion 135*c* respectively rise to the top surface 151*b* and the top surface 151*c* and move the second rib 141*b* and the third rib 141*c* by applying forces to the second rib 141*b* and the third rib 141*c* in a direction away from itself in the Z direction (see the arrow D in the drawings).

When the photoconductor drum 12 has been inserted into the housing 90, the photoconductor-drum side coupling 125 positioned at the end (downstream side end in the insertion direction) of the photoconductor drum 12 becomes engaged with the housing-side coupling 97.

Here, since the first bearing-side contact portion 135*a* is guided by the tapered portion 153*a* when the first bearing-side contact portion 135*a* rises to the top surface 151*a*, the first rib 141*a* is fitted into the groove 137*a* of the first bearing-side contact portion 135*a*. More specifically, the first bearing-side contact portion 135*a* is disposed so as to stride across the first rib 141*a* in the Y direction (see FIG. 4A). Thus, the position of a rear portion of the LPH 14 with respect to the photoconductor drum 12 is prevented from being changed in the Y direction.

Similarly, the third bearing-side contact portion 135*c* is disposed so as to stride across the third rib 141*c* in the Y direction. Thus, the position of a front portion of the LPH 14 with respect to the photoconductor drum 12 is prevented from being changed in the Y direction.

Although not described above, the housing 90 includes a positioning protrusion 98 (see FIG. 2) that protrudes from the downstream side to the upstream side in the insertion direction. The positioning protrusion 98 is caused to enter the positioning hole 121 as the photoconductor drum 12 is inserted into the housing 90. Thus, movement of the photoconductor drum 12 with respect to the housing 90 in the Y direction and the Z direction is restricted.

When the photoconductor drum 12 has been inserted into the housing 90, the hook 123 becomes engaged with the housing 90. Thus, movement of the photoconductor drum 12 with respect to the housing 90 in the X direction is restricted. In the example illustrated in the drawings, the position of the photoconductor drum 12 in the X direction is fixed by using the hook 123. However, the housing 90 may have a configuration in which an upstream-side end portion of the photoconductor drum 12 in the insertion direction is pressed downstream by using, for example, a plate member, such as an openable cover.

Referring now to FIGS. 4A and 4B, the state where the position of the LPH 14 with respect to the photoconductor drum 12 is fixed will be described.

As illustrated in FIGS. 4A and 4B, the first bearing-side contact portion 135*a* to the third bearing-side contact portion 135*c* of the photoconductor drum 12 and the first rib 141*a* to the third rib 141*c* of the LPH 14 are in the state of pressing against one another. In other words, both end portions of the LPH 14 are directly pressed by both end portions of the photoconductor drum 12. With this configuration, compared to the case where a component such as a portion of the housing 90 is interposed between the LPH 14 and the photoconductor drum 12, dimensional variation or other factors of the housing 90 affects to a lesser degree and thus the positioning accuracy is improved. Moreover, the LPH 14 is prevented from bending (sagging) due to a difference in coefficient of linear expansion between the housing 90 and parts of the LPH 14. Consequently, the depth of focus (DOF) of the LPH 14 is prevented from varying.

In the state where the position of the LPH 14 with respect to the photoconductor drum 12 is fixed, the first supportable portion 147*a* to the third supportable portion 147*c* are respectively disposed in the first through-hole 155*a* to the third through-hole 155*c* without being in contact with the frame 50 and thus are not pressed by the frame 50. More specifically, in the exemplary embodiment, the first supportable portion 147*a* to the third supportable portion 147*c* are separated from a first bottom portion 156*a* to a third bottom portion 156*c* of the first through-hole 155*a* to the third through-hole 155*c*. Thus, the position of the LPH 14 is not changed due to the first supportable portion 147*a* to the third supportable portion 147*c* respectively coming into contact with the first bottom portion 156*a* to the third bottom portion 156*c* of the first through-hole 155*a* to the third through-hole 155*c*.

In the example illustrated in the drawings, the sum of the heights of the first rib 141*a* and the first bearing-side contact portion 135*a* in the Z direction, the sum of the heights of the second rib 141*b* and the second bearing-side contact portion 135*b* in the Z direction, and the sum of the heights of the third rib 141*c* and the third bearing-side contact portion 135*c* in the Z direction coincide with one another. Thus, in the state where the first rib 141*a* to the third rib 141*c* are respectively in contact with the first bearing-side contact portion 135*a* to the third bearing-side contact portion 135*c*, the rod lens array 143 and the photoconductor drum body 120 are parallel to each other.

The configuration in which each rib 141 has a corresponding one of the inclined surfaces 149*a* to 149*c* has been described above. However, the present invention is not limited to this configuration as long as the photoconductor drum 12 directly pushes the LPH 14 away as the photoconductor drum 12 is being inserted. Thus, a configuration in which the contact portions 135 each have an inclined surface or in which both of the ribs 141 and the contact portions 135 have inclined surfaces may be employed, for example.

A configuration including a so-called lifting mechanism that is different from the configuration according to the exemplary embodiment is conceivable. Specifically, in this configuration, the LPH 14 is movable between a use position and a retract position. After the photoconductor drum 12 is inserted into the housing 90 while the LPH 14 is in the retract position, the LPH 14 is moved to the use position by, for example, a users' operation. However, the configuration according to the exemplary embodiment is simpler than the configuration including the lifting mechanism. Moreover, the configuration according to the exemplary embodiment dispenses with an operation of additionally moving the LPH 14 when the photoconductor drum 12 is inserted into or removed from the housing 90.

Second Exemplary Embodiment

Figure 11:
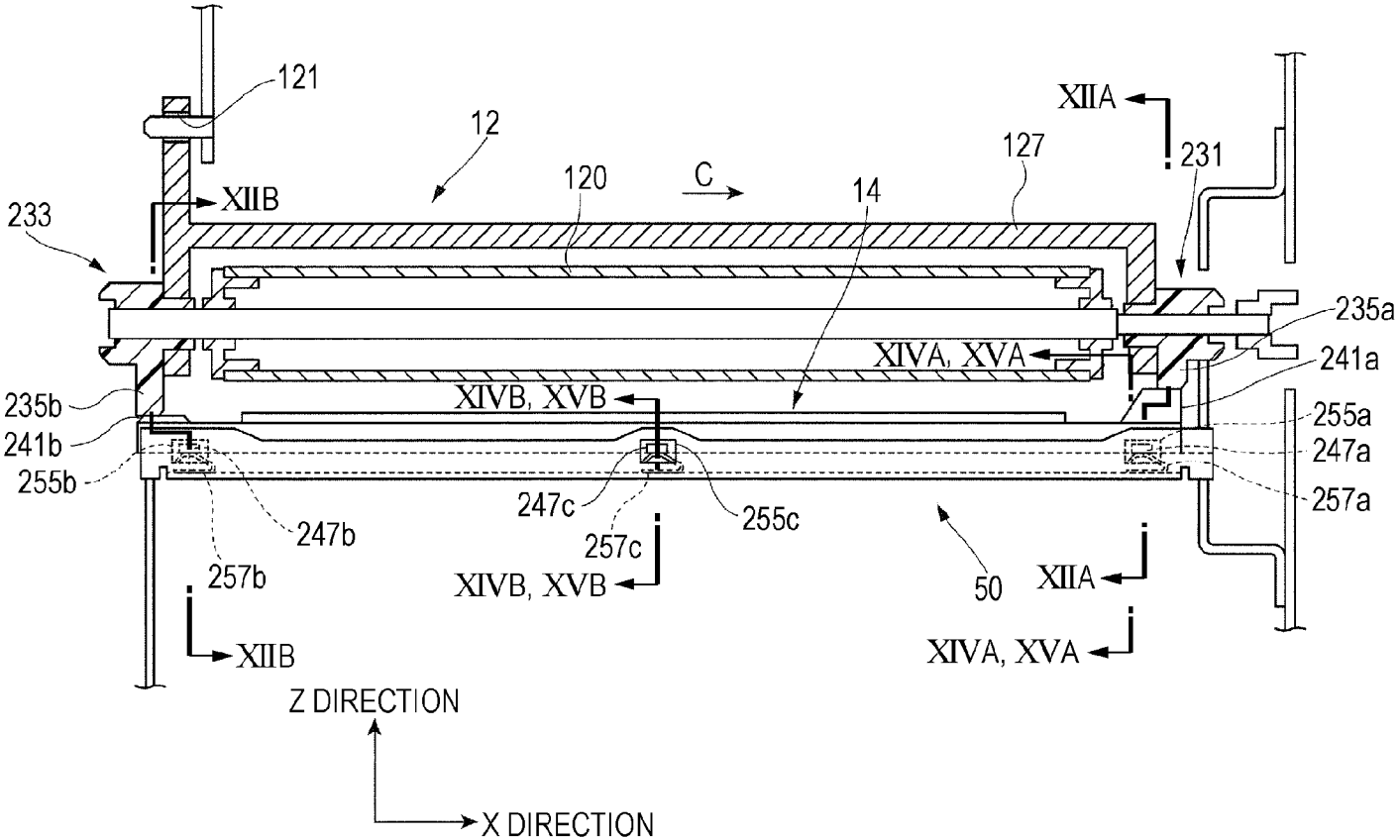
FIG. 11 is a schematic diagram of surroundings of a photoconductor drum and an LPH according to a second exemplary embodiment.

Referring now to FIG. 11, a second exemplary embodiment will be described. FIG. 11 is a schematic diagram illustrating the surroundings of a photoconductor drum 12 and an LPH 14 according to the second exemplary embodiment and corresponds to FIG. 2 illustrating the first exemplary embodiment.

As illustrated in FIG. 11, the second exemplary embodiment has a mechanism in which, while the photoconductor drum 12 is pressing the LPH 14, a frame 50 and the LPH 14 (a third supportable portion 247*c* and a third through-hole 255*c*) are in contact with each other in a center portion in the X direction, thereby restricting movement of the LPH 14 in the Y direction.

Figure 12B:
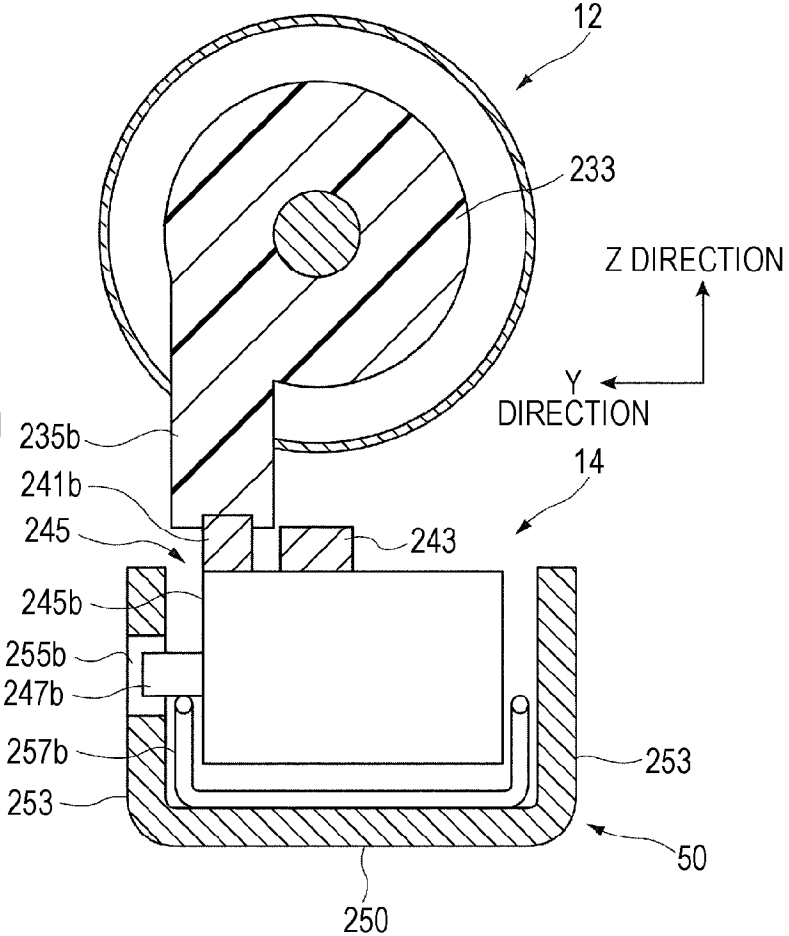
FIGS. 12A and 12B are schematic diagrams of the photoconductor drum and the LPH.
Figure 12A:
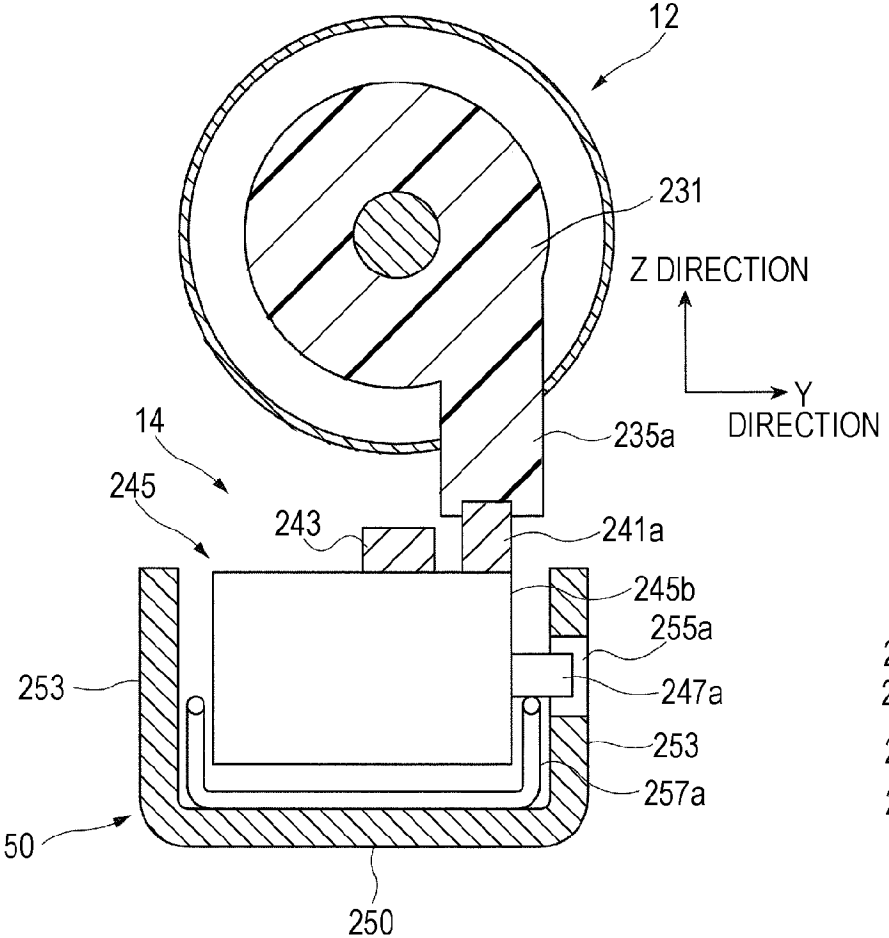

Referring now to FIGS. 12A and 12B, a configuration of the photoconductor drum 12 and the LPH 14 will be described. FIGS. 12A and 12B are schematic diagrams of the photoconductor drum 12 and the LPH 14. More specifically, FIG. 12A is a cross-sectional view taken along the line XIIA-XIIA of FIG. 11 while FIG. 12B is a cross-sectional view taken along the line XIIB-XIIB of FIG. 11. In FIGS. 12A and 12B, the covering member 127 of the photoconductor drum 12 is omitted.

On the rear side, the LPH 14 includes a first rib 241*a* and a first supportable portion 247*a*, the frame 50 includes a first spring member 257*a* and a first through-hole 255*a*, and a rear bearing 231 includes a first bearing-side contact portion 235*a*. On the front side, the LPH 14 includes a second rib 241*b* and a second supportable portion 247*b*, the frame 50 includes a second spring member 257*b* and a second through-hole 255*b*, and a front bearing 233 includes a second bearing-side contact portion 235*b*.

The first rib 241*a*, the second rib 241*b*, the first supportable portion 247*a*, and the second supportable portion 247*b* are formed on one side (on the right side in FIG. 12A) of the holder 245 and of the photoconductor drum 12 in the Y direction.

Figure 13A:
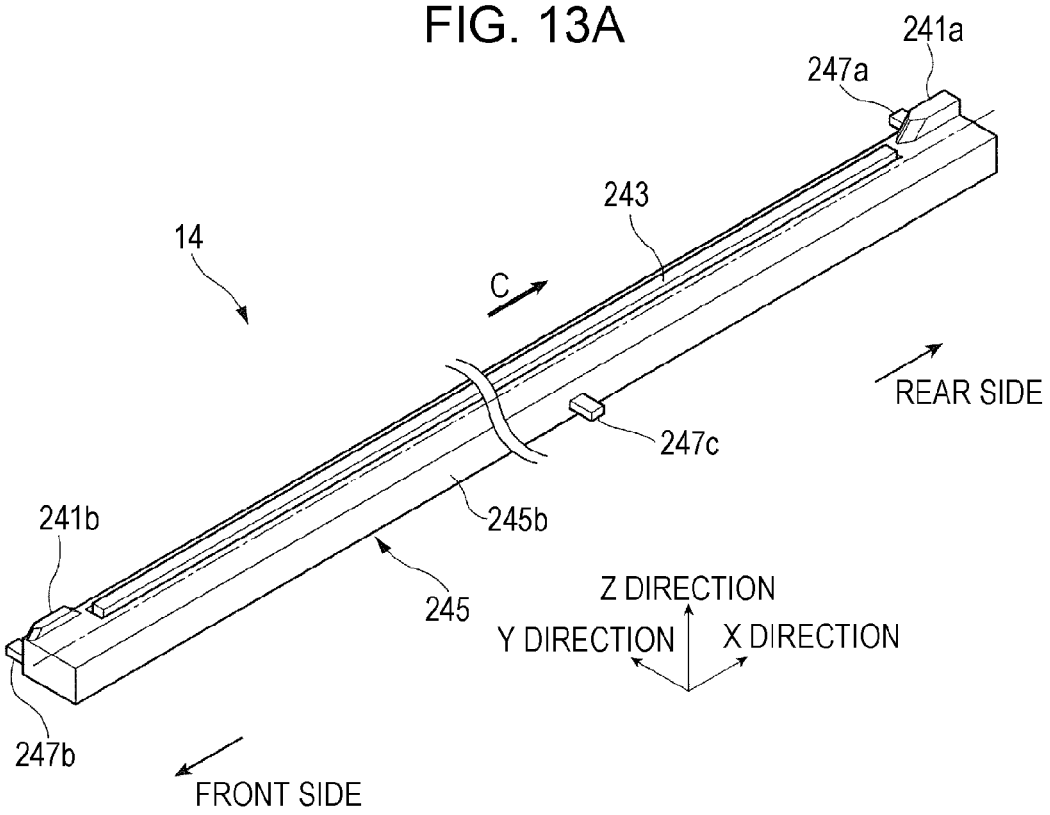
FIGS. 13A and 13B are schematic diagrams of the LPH.
Figure 13B:
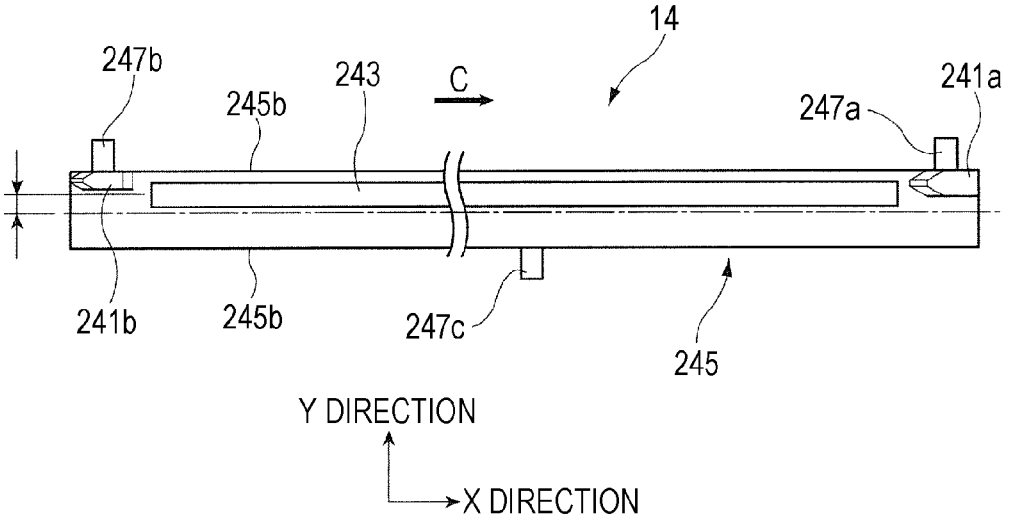

Referring now to FIGS. 13A and 13B, the configuration of the LPH 14 will be described. FIGS. 13A and 13B illustrate a schematic configuration of the LPH 14. More specifically, FIG. 13A is a perspective view of the LPH 14 and FIG. 13B is a top view of the LPH 14.

As illustrated in FIG. 13A, the LPH 14 includes a rod lens array 243 at a position that is away from the center in the Y direction toward the first rib 241*a* and the second rib 241*b*.

As illustrated in FIG. 13B, a holder 245 of the LPH 14 has a third supportable portion 247*c* in a center portion in the X direction on a side surface 245*b* opposite to a side surface 245*b* on which the first supportable portion 247*a* and the second supportable portion 247*b* are formed. The frame 50 includes a third spring member 257*c* (see FIG. 11) that urges the third supportable portion 247*c* toward the photoconductor drum 12.

Referring now to FIGS. 14A, 14B and 15A to 15C, the configuration of the LPH 14 and the frame 50 will be described.

Figure 14A:
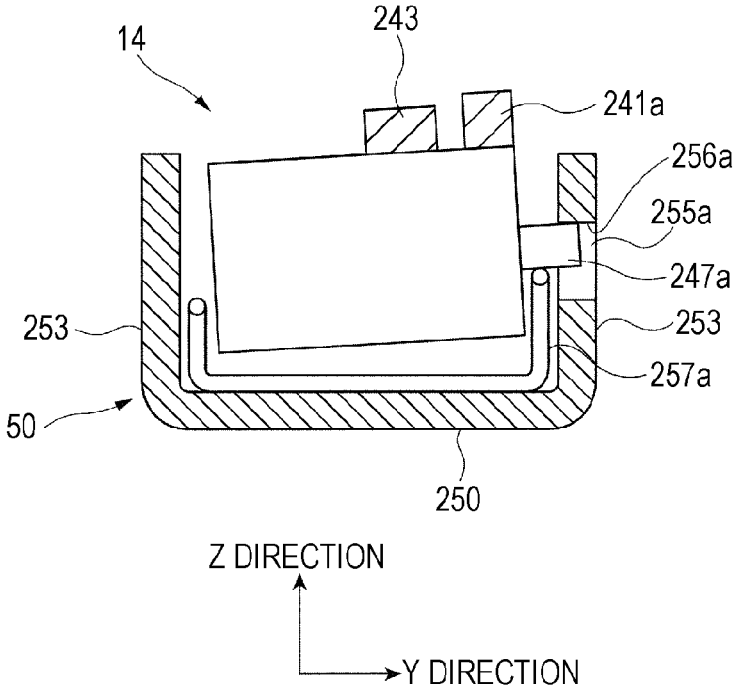
FIGS. 14A and 14B are schematic diagrams of the LPH and a frame that are not being pressed by the photoconductor drum.
Figure 14B:
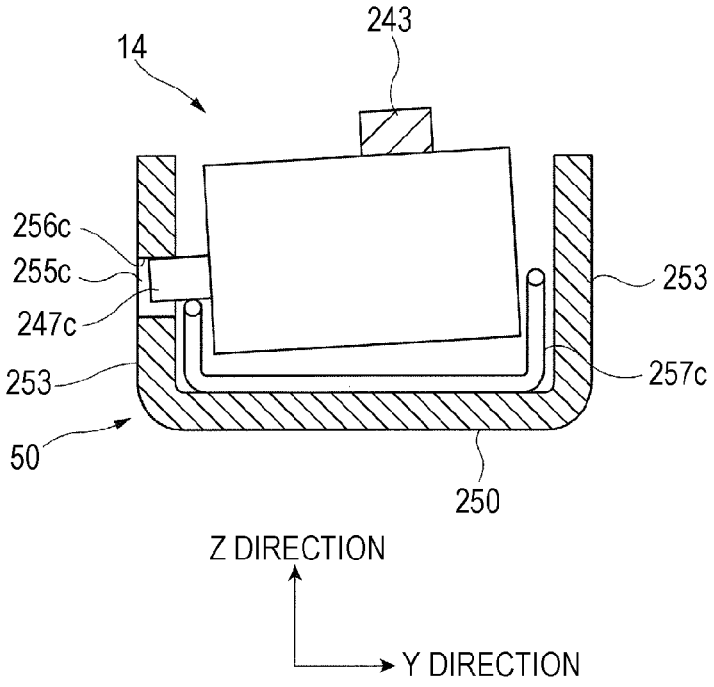

FIGS. 14A and 14B are schematic diagrams of the LPH 14 and the frame 50 that are in the state of not being pressed by the photoconductor drum 12. More specifically, FIG. 14A is a cross-sectional view taken along the line XIVA-XIVA of FIG. 11 and FIG. 14B is a cross-sectional view taken along the line XIVB-XIVB of FIG. 11.

Figure 15A:
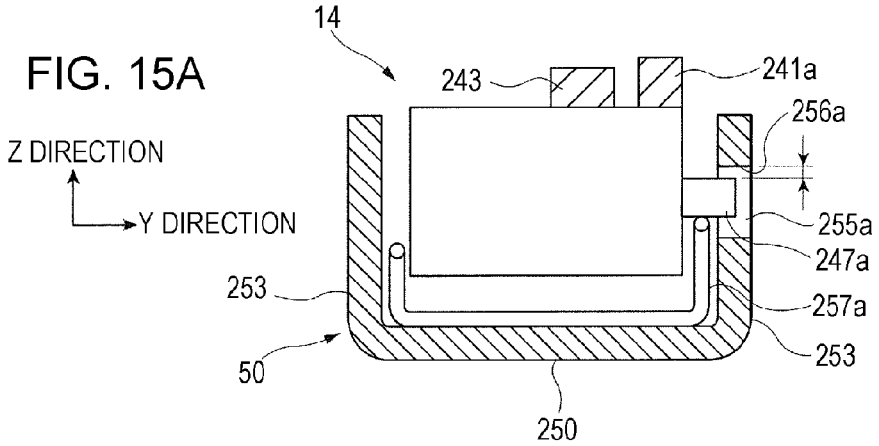
FIGS. 15A, 15B and 15C are schematic diagrams of the LPH and the frame that are being pressed by the photoconductor drum.
Figure 15B:
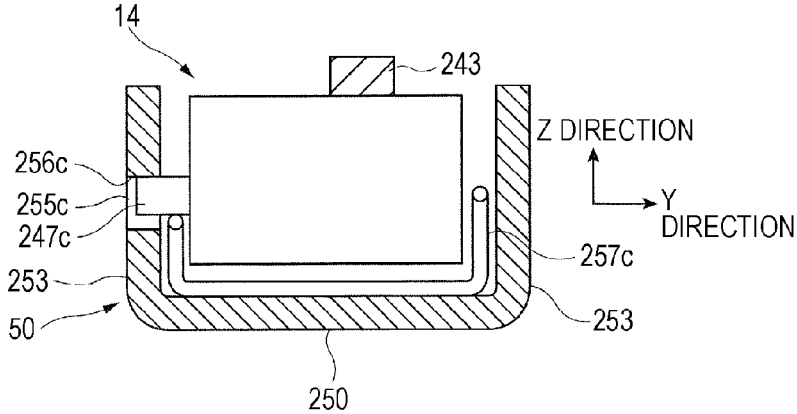
Figure 15C:
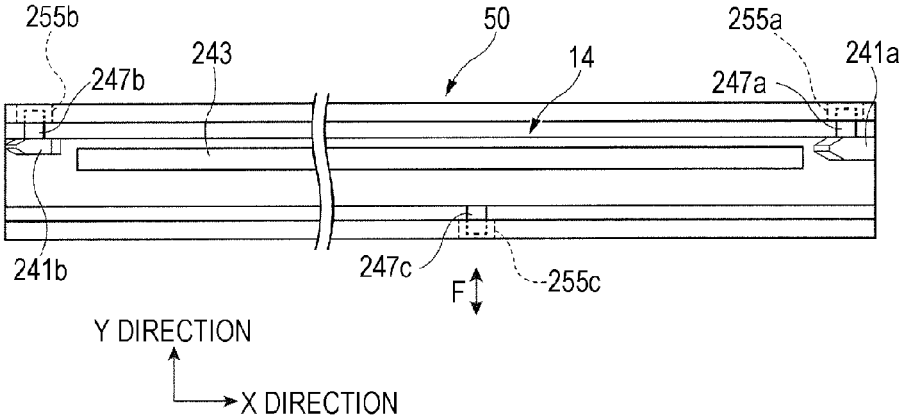

FIGS. 15A to 15C are schematic diagrams of the LPH 14 and the frame 50 that are in the state of being pressed by the photoconductor drum 12. More specifically, FIG. 15A is a cross-sectional view taken along the line XVA-XVA of FIG. 11, FIG. 15B is a cross-sectional view taken along the line XVB-XVB of FIG. 11, and FIG. 15C is a top view of the LPH 14 and the frame 50.

As illustrated in FIGS. 14A and 14B, the positions of the first through-hole 255*a* and the second through-hole 255*b* (see FIG. 11) in the Z direction are different from the position of the third through-hole 255*c* in the Z direction. More specifically, a first ceiling portion 256*a* of the first through-hole 255*a* and a second ceiling portion (not illustrated) of the second through-hole 255*b* are located at positions farther from a base portion 250 than the third ceiling portion 256*c* of the third through-hole 255*c* is.

For this reason, in the state where the LPH 14 is not being pressed by the photoconductor drum 12, as illustrated, the holder 245 (see FIGS. 13A and 13B) is inclined such that one side (right side in FIG. 14) of the holder 245 in the Y direction protrudes toward the photoconductor drum 12.

As illustrated in FIG. 15A, in the state where the LPH 14 is pressed by the photoconductor drum 12, the first supportable portion 247*a* and the second supportable portion 247*b* are not in contact with the first ceiling portion 256*a* of the first through-hole 255*a* and the second ceiling portion (not illustrated) of the second through-hole 255*b* (see the arrows in FIG. 15A). Thus, the position of the LPH 14 in the Z direction with respect to the photoconductor drum 12 is determined with just the LPH 14 and the photoconductor drum 12 regardless of the position of the frame 50.

As illustrated in FIG. 15B, in the state where the LPH 14 is pressed by the photoconductor drum 12, the third supportable portion 247*c*, on the other hand, is in contact with the third ceiling portion 256*c* of the third through-hole 255*c*.

Here, as illustrated in FIG. 15C, the rod lens array 243 is located at a smaller distance from the first supportable portion 247*a* and the second supportable portion 247*b* than from the third supportable portion 247*c*. For this reason, even in the state where the third supportable portion 247*c* is in contact with the third ceiling portion 256*c*, the position of the rod lens array 243 in the Z direction varies to a lesser extent in the Z direction compared to the case where the rod lens array 243 is located near the third supportable portion 247*c* due to dimensional deviation of the position of the third ceiling portion 256*c*, which supports the third supportable portion 247*c*, in the Z direction.

When the third supportable portion 247*c* comes into contact with the third ceiling portion 256*c* of the third through-hole 255*c* and receives frictional force, the LPH 14 is prevented from moving in the Y direction (see the arrow F in FIG. 15C). More specifically, when the third supportable portion 247*c* is formed in a center portion of the LPH 14 in the X direction as illustrated in FIG. 15C, the LPH 14 is prevented from bending or vibrating in the Y direction compared to the case where third supportable portions 247*c* are formed on both end portions of the LPH 14 in the X direction. This configuration prevents the position of an electrostatic latent image formed on the surface of the photoconductor drum body 120 from being periodically changed in a subscan direction. Consequently, the toner density of a toner image in the subscan direction is prevented from varying (so-called banding is prevented).

In the exemplary embodiment, bending of the LPH 14 due to an application of an external force to the LPH 14 from another component is prevented compared to, for example, a configuration in which a center portion of the LPH 14 in the X direction is fixed by being held by another component.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image carrier configured to rotate; and an exposure unit configured to expose the image carrier to light, the exposure unit including a plurality of light emitters, a holding unit, and first contact portions, the plurality of light emitters arranged along a rotation axis direction of the image carrier, the holding unit configured to hold the plurality of light emitters, the first contact portions positioned on the holding unit so as to sandwich the plurality of light emitters therebetween, wherein the exposure unit is configured to move away from the image carrier in an optical axis direction of the exposure unit in response to the image carrier being pushed against the first contact portions, and the exposure unit and the image carrier are configured to be positioned with respect to each other in response to the first contact portions coming into contact with the image carrier, wherein the first contact portions comprise at least two first contact portions protruding in the optical axis direction of the exposure unit and sandwiching the plurality of light emitters therebetween, and wherein one of the at least two first contact portions that is located on a downstream side in a direction in which the image carrier is configured to be inserted protrudes to a larger degree than another one of the at least two first contact portions that is located on an upstream side in the direction in which the image carrier is configured to be inserted.

2. The image forming apparatus according to claim 1, further comprising:

a pressing unit configured to press the exposure unit in the optical axis direction, wherein the holding unit includes a second contact portion configured to come into contact with the apparatus body, and wherein when the first contact portions are not in contact with the image carrier, movement of the exposure unit in the optical axis direction is restricted by the second contact portion coming into contact with the apparatus body, whereas when the first contact portions are in contact with the image carrier, the second contact portion and the apparatus body are no longer in contact with each other and the exposure unit is positioned with respect to the image carrier.

3. The image forming apparatus according to claim 1, wherein the exposure unit includes a second contact portion in a center portion of the image carrier in the rotation axis direction of the image carrier, the second contact portion configured to come into contact with a body of the image forming apparatus and configured to be movable in the optical axis direction of the exposure unit and in a direction that crosses the rotation axis direction of the image carrier.

4. An exposure device comprising:

an exposing member that includes a plurality of light emitters arranged along a rotation axis direction of an image carrier configured to rotate, the exposing member configured to expose the image carrier with light;

a supporter configured to support the image carrier and the exposing member; and a guide portion formed on the exposing member and protruding into a path along which the image carrier is configured to be inserted into the supporter in the rotation axis direction of the image carrier, the guide portion configured to guide the exposing member in an optical axis direction of the exposing member to a predetermined position in response to the guide portion being pressed by the image carrier, wherein the guide portion comprises first and second guide portions protruding in the optical axis direction of the exposure member and sandwiching the plurality of light emitters therebetween, and wherein the first guide portion is located on a downstream side in a direction in which the image carrier is configured to be inserted and protrudes to a larger degree than the second guide portion that is located on an upstream side in the direction in which the image carrier is configured to be inserted.

5. The exposure device of claim 4, wherein the first and second guide portions include inclined surfaces which are inclined to become increasingly separated from a top surface of the supporter as the inclined surfaces extend from the upstream side to the downstream side in the direction in which the image carrier is configured to be inserted.

6. The image forming apparatus of claim 1, wherein the at least two first contact portions include inclined surfaces which are inclined to become increasingly separated from a top surface of the holding unit as the inclined surfaces extend from the upstream side to the downstream side in the direction in which the image carrier is configured to be inserted.

* * * * *